US011629578B2

(12) United States Patent
Rowaihy et al.

(10) Patent No.: US 11,629,578 B2
(45) Date of Patent: Apr. 18, 2023

(54) PROCEDURES FOR SELECTIVE WATER SHUT OFF OF PASSIVE ICD COMPARTMENTS

(71) Applicant: Saudi Arabian Oil Company, Dhahran (SA)

(72) Inventors: Feras Hamid Rowaihy, Dhahran (SA); Ahmed A. Al Sulaiman, Dammam (SA); Suresh Jacob, Dhahran (SA); Ayman Almohsin, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 85 days.

(21) Appl. No.: 17/235,021

(22) Filed: Apr. 20, 2021

(65) Prior Publication Data

US 2022/0333466 A1 Oct. 20, 2022

(51) Int. Cl.
*E21B 43/112* (2006.01)
*E21B 33/124* (2006.01)
(Continued)

(52) U.S. Cl.
CPC ..... *E21B 43/112* (2013.01); *E21B 33/1243* (2013.01); *E21B 43/12* (2013.01); *E21B 43/119* (2013.01)

(58) Field of Classification Search
CPC ..... E21B 43/112; E21B 43/12; E21B 43/119; E21B 33/1243
See application file for complete search history.

(56) References Cited

U.S. PATENT DOCUMENTS 5,090,478 A * 2/1992 Summers ..... C09K 8/56 166/278
5,361,843 A * 11/1994 Shy ..... E21B 43/116 166/242.1

(Continued)

FOREIGN PATENT DOCUMENTS

EP 0314268 B1 3/1989

OTHER PUBLICATIONS

Aadnoy et al., "Analysis of Inflow Control Devices", Society of Petroleum Engineers, SPE 122824, 2009.

(Continued)

*Primary Examiner* — D. Andrews
(74) *Attorney, Agent, or Firm* — Dinsmore & Shohl LLP

(57) ABSTRACT

A method for shutting off a wet interval of a wellbore includes producing hydrocarbons from a hydrocarbon bearing subterranean formation through a production string installed in the wellbore, identifying the wet interval of the wellbore, perforating the production string in the wet interval using an explosive-free punch tool to produce a plurality of openings in the production string, isolating the production string in the wet interval, treating the wet interval with a sealing composition injected through the plurality of openings into an annulus of the wellbore in the wet interval, and restoring a fluid flow path through the production string in the wet interval. The restored fluid flow path through the wet interval enables continued production of hydrocarbons from downhole intervals, while the sealing composition cured in the annulus provides a barrier to prevent fluid flow from the wet interval into the production string.

20 Claims, 8 Drawing Sheets

(51) Int. Cl.
*E21B 43/12* (2006.01)
*E21B 43/119* (2006.01)

(56) References Cited

U.S. PATENT DOCUMENTS

| | | | | |
|---|---|---|---|---|
| 5,507,345 | A * | 4/1996 | Wehunt, Jr. | E21B 33/138 166/292 |
| 5,671,809 | A * | 9/1997 | McKinzie | E21B 33/124 166/147 |
| 8,136,584 | B2 | 3/2012 | Burnett et al. | |
| 8,403,047 | B2 * | 3/2013 | Blount | E21B 43/14 166/279 |
| 10,287,860 | B2 | 5/2019 | Babin et al. | |
| 2018/0274342 | A1 * | 9/2018 | Sites | F42B 3/22 |
| 2020/0378212 | A1 | 12/2020 | Wardley et al. | |

OTHER PUBLICATIONS

Bourgoin et al., "Clad Through Clad: A Mechanical Water Shut Off Solution for Commingled Production from Multilayered Reservoirs", Society of Petroleum Engineers, SPE-171922-MS, 2014.
Langass et al., "Water Shut-Off with Polymer in the Alvheim Field", Society of Petroleum Engineers, SPE-195485-MS.

* cited by examiner

PROCEDURES FOR SELECTIVE WATER SHUT OFF OF PASSIVE ICD COMPARTMENTS

BACKGROUND

Field

The present disclosure relates to natural resource well drilling and hydrocarbon production from subterranean formations, in particular, to methods or procedures for selective water shut-off of wet intervals of a wellbore competed with passive inflow control devices (ICD).

Technical Background

Production of hydrocarbons from a subterranean formation generally includes drilling at least one wellbore into the subterranean formation. The wellbore forms a pathway capable of permitting both fluids and apparatus to traverse between the surface and the subterranean formations. Besides defining the void volume of the wellbore, the wellbore wall also acts as the interface through which fluid can transition between the formations through which the wellbore traverses and the interior of the well bore. Hydrocarbon producing wellbores extend subsurface and intersect various hydrocarbon-bearing subterranean formations where hydrocarbons are trapped. Well drilling techniques can include forming horizontal wells or multilateral wells that include lateral branches that extend horizontally outward from a central wellbore.

Passive Inflow Control Devices (passive ICDs) are used in many wells to balance inflow along the wellbore, to delay water breakthrough, and to prolong the life of the well. Typically, ICD completion of the wellbore includes installation of a plurality of passive ICDs distributed across a plurality of intervals of the wellbore, where the intervals are segmented by packers. Segmentation of the wellbore into a plurality of intervals and installation of the plurality of ICDs can equalize the flow rates from different portions of the hydrocarbon bearing subterranean formation. The number and size of each passive ICD is selected at the time of completion design based on factors such as expected production rate, number of intervals, petrophysical and fluid properties, and other factors or combinations of factors.

SUMMARY

As hydrocarbon resource wells mature, water begins to arrive at one or more of the intervals of the wellbore through high-permeable zones of the hydrocarbon bearing subterranean formation. The water can come from water regions naturally occurring in the subterranean formation or from reservoir treatments, such as water flooding treatments or other aqueous chemical treatments, to enhance oil recovery. The water flow from the hydrocarbon bearing formation into the wellbore increases with time, which can significantly affect the performance of the wellbore for producing hydrocarbons. In particular, water flow into the wellbore can increase water production and reduce the hydrocarbon production rate from the wellbore. Intervals of the wellbore from which an excessive amount of water (such as greater than or equal to 50% water by volume) is produced are referred to throughout the present disclosure as wet intervals.

Water shut-off techniques applied to one or more wet intervals of the wellbore can reduce or prevent the flow of water from the subterranean formation into the wellbore in the wet interval, thereby improving well performance. For passive ICDs, mechanical water shut off techniques are often utilized due to the simple implementation of these techniques, which include but are not limited to ICD patches, straddle packers, and other mechanical isolation devices that can be installed downhole. However, mechanical water shut off techniques are effective for only a limited amount of time, because these mechanical water shut off techniques only isolate the inflow control device and do not extend outward into the annulus and into the subterranean formation. Chemical water shut off techniques, such as injection of cements or other sealing materials into the wet interval, can also be used for water shut off and can increase the lifespan of the water shut off installation by expanding treatment into the annulus and the subterranean formation. However, implementation of chemical water shut offs in passive ICDs is challenging and often impractical due to the small openings or nozzles (2 mm-6 mm ID nozzles) of the passive ICDs installed in each of the intervals. Typically, the inflow areas of a passive ICD are very small, such as nozzles having an inside diameter in the range of from 2 millimeters (mm) to 6 mm ID nozzles, thereby adding a high mechanical skin to reduce inflow through each passive ICD. The small ICD openings can make it difficult to inject chemical treatments, such as cements or polymeric sealing materials, into the subterranean formation at the wet interval.

Accordingly, there is an ongoing need for methods for water shut off of wet intervals of a wellbore completed with passive ICDs. The present disclosure is directed to methods for water shut off of a wet interval of a wellbore, where the wellbore is completed with a production string comprising a plurality of passive ICDs at least one of which is disposed in the wet interval portion of the production string. The methods of the present disclosure include perforating the wet interval portion of the production string using an explosive-free perforation tool to produce a plurality of openings in the production string, such as the production tubing or passive ICDs in the wet interval. The explosive-free perforation tool provides larger openings around and across the wet interval to enable injection of sealing compositions from the production string into the annulus and the subterranean formation beyond the annulus. The explosive-free perforation tool may allow for more precise control of the size and placement of the openings in the wet interval portion of the production string and may reduce or prevent damage to packers at the ends of the wet interval, which can lead to crossflow between intervals. The explosion-free perforation tool can be manipulated axially and angularly within the production string to distribute the openings angularly around the production string and axially throughout the wet interval portion of the production string.

Once the wet interval portion of the production string is perforated, the methods of the present disclosure may further include isolating the wet interval and injecting a sealing composition through the openings and into at least the annulus, which is defined between the production string and the wellbore wall. Injection of the sealing compositions may further continue to push the sealing compositions further into the subterranean formation. The methods further include allowing the sealing composition to cure and then restoring a fluid flow path axially through the wet interval portion of the production string so that hydrocarbon production from downhole intervals can be resumed. The sealing composition cured in the annulus provides a barrier to prevent fluid flow from the wet interval of the wellbore into the production string.

The methods of the present disclosure may enable chemical water shut off of wet intervals comprising passive ICDs in a very safe and integral manner. The methods of the present disclosure may also provide for perforation of the production string without causing loss of integrity of packers and cross-flow between compartments, particularly when perforating portions of the production tubing in close proximity to the packers. Additionally, the methods of the present disclosure may improve oil production and maximize oil recovery from the wellbore, prolong the lifespan of the wellbore, extend the high production plateau of the wellbore, and save reservoir energy through reduction of water production. The restored fluid flow path may allow for continued wellbore logging of downhole intervals. The methods of the present disclosure can also be implemented without using a drilling rig, which can reduce the cost of the treatment, among other features.

According to a first aspect of the present disclosure, a method for shutting off a wet interval of a wellbore may include producing hydrocarbons from a hydrocarbon bearing subterranean formation through a production string installed in the wellbore. The production string may include production tubing, a plurality of packers separating the wellbore into a plurality of intervals, and a plurality of passive inflow control devices positioned across one or more of the plurality of intervals. The method may further include identifying the wet interval of the wellbore, where the production string in the wet interval may comprise at least one of the plurality of passive inflow control devices. The method may further include perforating the production string in the wet interval using an explosive-free punch tool to produce a plurality of openings in the production string in the wet interval and isolating the production string in the wet interval from uphole segments of the production string, downhole segments of the production string, or both. The method may further include treating the wet interval with a sealing composition injected through the plurality of openings into an annulus in the wet interval and restoring a fluid flow path through the production string in the wet interval. The fluid flowpath through the production string in the wet interval may enable production of hydrocarbons from downhole intervals through the wet interval to a surface of the wellbore, and the sealing composition cured in the annulus may provide a barrier to prevent fluid flow from the wet interval into the fluid flow path.

A second aspect of the present disclosure may include the first aspect, where the plurality of openings produced in the production string may be formed in the production tubing, the at least one of the plurality of passive inflow control devices, or both of the production string in the wet interval.

A third aspect of the present disclosure may include either one of the first or second aspects, where perforating the production string in the wet interval may include positioning the explosion-free punch tool within the production string in the wet interval and operating the explosion-free punch tool to produce the plurality of openings in the production string.

A fourth aspect of the present disclosure may include the third aspect, where positioning the explosion-free punch tool within the production string may be conducted using a slickline, wireline, or coiled tubing.

A fifth aspect of the present disclosure may include any one of the first through fourth aspects, where perforating the production string in the wet interval may comprise producing the plurality of openings at multiple axial locations of the wet interval portion of the production string relative to a center axis of the production string.

A sixth aspect of the present disclosure may include the fifth aspect, where producing the plurality of openings at multiple axial locations may comprise operating a single explosion-free punch tool at a plurality of different depths throughout the wet interval.

A seventh aspect of the present disclosure may include the fifth aspect, where producing the plurality of openings at multiple axial locations may comprise coupling a plurality of explosion-free punch tools in series and positioning the plurality of explosion-free punch tools within the production string in the wet interval so that the plurality of explosion-free punch tools may be distributed axially throughout the wet interval.

An eighth aspect of the present disclosure may include any one of the first through seventh aspects, where perforating the production string in the wet interval may comprise producing the plurality of openings distributed angularly through 360 degrees relative to a center axis of the production string.

A ninth aspect of the present disclosure may include the eighth aspect, where producing the plurality of openings distributed angularly through 360 degrees may comprise rotating the explosion-free punch tool within the production string by an angle less than 180 degrees between each operation of the explosion-free punch tool.

A tenth aspect of the present disclosure may include either one of the eighth or ninth aspects, where perforating the production string in the wet interval may comprise producing the plurality of openings at a plurality of axial locations of the wet interval portion of the production string relative to the center axis of the production string.

An eleventh aspect of the present disclosure may include any one of the first through tenth aspects, where perforating the production string in the wet interval does not result in loss of integrity of any of the plurality of packers disposed between intervals and does not result in cross-flow of fluids through the annulus between intervals.

A twelfth aspect of the present disclosure may include any one of the first through eleventh aspects, where each of the plurality of openings may have a diameter of from 6 millimeters to 20 millimeters.

A thirteenth aspect of the present disclosure may include any one of the first through twelfth aspects, where each of the plurality of openings are the same size.

A fourteenth aspect of the present disclosure may include any one of the first through thirteenth aspects, where isolating the production string in the wet interval may comprise installing an inflatable packer within the production string at a downhole end of the wet interval and installing a cement retainer within the production string at an uphole end of the wet interval.

A fifteenth aspect of the present disclosure may include the fourteenth aspect, where the cement retainer may be an inflatable cement retainer.

A sixteenth aspect of the present disclosure may include any one of the first through fifteenth aspects, where treating the wet interval with the sealing composition may include dispensing the sealing composition through the production string, through the plurality of openings in the production string in the wet interval, and into an annulus of the wellbore in the wet interval—where the annulus may be the annular volume defined between the production string and a wellbore wall of the wellbore—and curing the sealing composition in the annulus of the wellbore in the wet interval.

A seventeenth aspect of the present disclosure may include the sixteenth aspect, comprising dispensing the sealing composition into the annulus of the wellbore until the sealing composition penetrates into the subterranean formation in the wet interval.

An eighteenth aspect of the present disclosure may include any one of the first through seventeenth aspects, where the sealing composition may comprise a cement, a curable polymer, or combinations of these.

A nineteenth aspect of the present disclosure may include any one of the first through eighteenth aspects, further comprising, after treating the wet interval with a sealing composition, confirming isolation of the wet interval from the production string.

A twentieth aspect of the present disclosure may include the nineteenth aspect, where confirming isolation of the wet interval may comprise conducting a negative pressure test.

A twenty-first aspect of the present disclosure may include the nineteenth aspect, where confirming isolation of the wet interval from the production string may be conducted after the sealing composition is cured.

A twenty-second aspect of the present disclosure may include any one of the first through twenty-first aspects, where restoring a fluid flowpath through the production string in the wet interval may comprise removing an inflatable cement retainer disposed within the production string at an uphole end of the wet interval, cleaning out the sealing composition from a central cavity of the production string in the wet interval, and removing an inflatable packer disposed within the production string at a downhole end of the wet interval.

A twenty-third aspect of the present disclosure may include the twenty-second aspect, where cleaning out the sealing composition from the central cavity may comprise alternating jetting and drifting. Jetting may include directing a fluid jet into the central cavity to remove the sealing composition from the central cavity, and drifting may include measuring an internal diameter of the production string.

A twenty-fourth aspect of the present disclosure may include any one of the first through twenty-third aspects, where identifying the wet interval of the wellbore may comprise analyzing results from production logging showing hydrocarbon and water production contributions for each of the plurality of intervals of the wellbore.

A twenty-fifth aspect of the present disclosure may include any one of the first through twenty-fourth aspects, where the wet interval may be an interval of the wellbore that produces a water cut that may be at least 50% of a total volume of fluids produced from that interval.

A twenty-sixth aspect of the present disclosure may include any one of the first through twenty-fifth aspects, where the method may be conducted without the installation of or use of a production rig.

A twenty-seventh aspect of the present disclosure may include any one of the first through twenty-sixth aspects, where the plurality of intervals of the wellbore may be in a horizontal portion of the wellbore.

A twenty-eighth aspect of the present disclosure may include any one of the first through twenty-seventh aspects, where each interval of the wellbore may be fluidly isolated from every other interval by a plurality of packers that block fluid flow uphole and downhole through an annulus between the production string and the wellbore wall.

A twenty-ninth aspect of the present disclosure may include any one of the first through twenty-eighth aspects, further comprising resuming production of hydrocarbons from intervals of the wellbore 100 disposed downhole relative to the wet interval 162.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which:

FIGS. 1-8 are not to scale and certain dimensions may be exaggerated for purposes of illustration. Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 2:
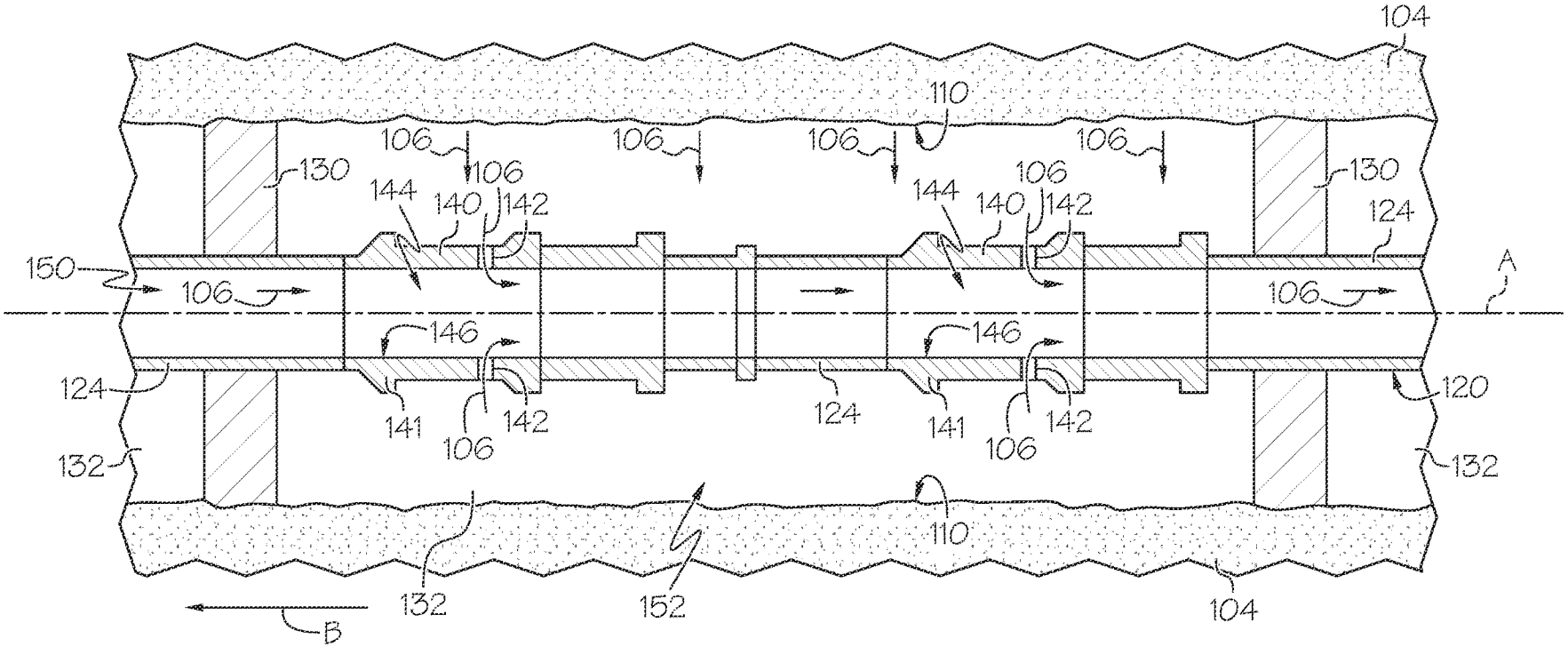
FIG. 2 schematically depicts a side cross-sectional view of an interval of the production string depicted in FIG. 1 during hydrocarbon production, according to one or more embodiments shown and described in this disclosure.
Figure 3:
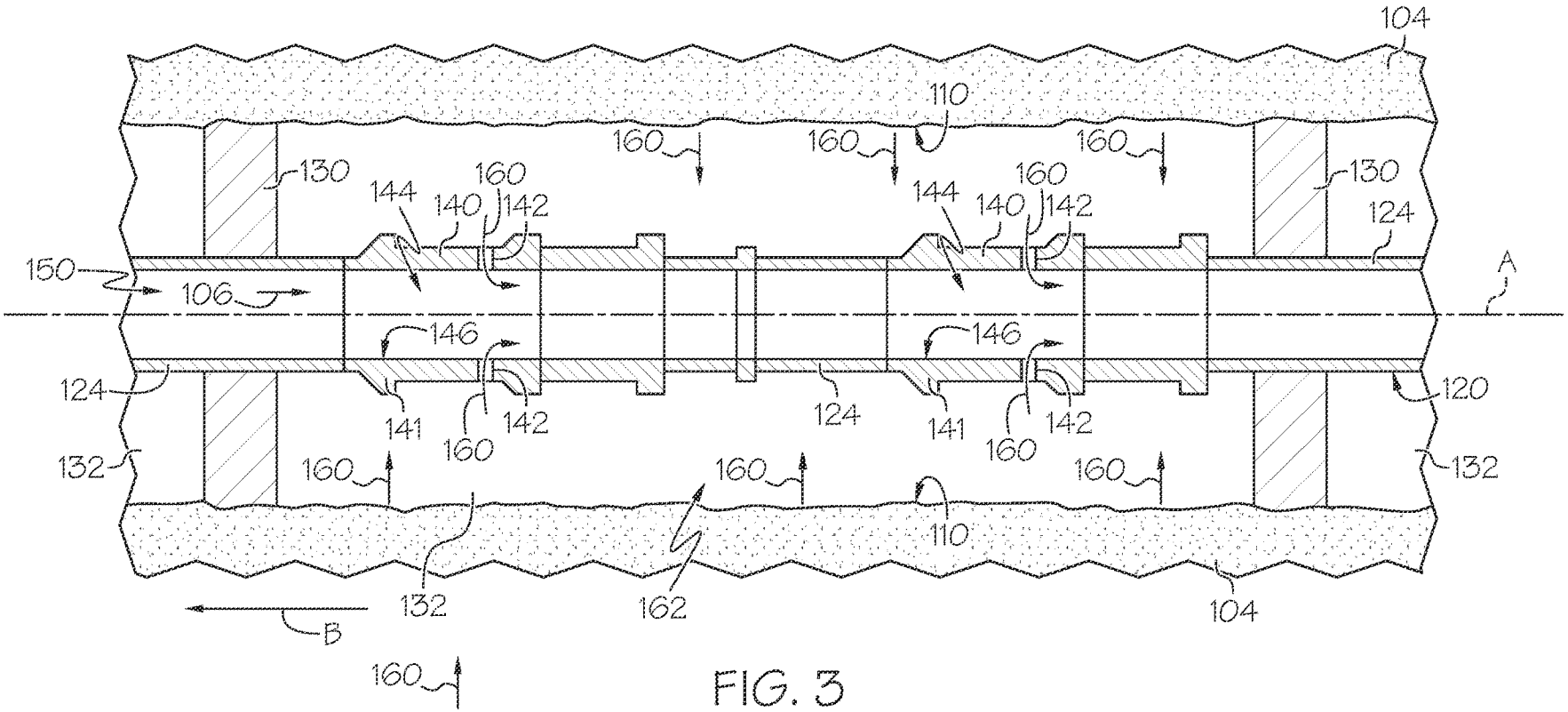
FIG. 3 schematically depicts a side cross-sectional view of a wet interval portion of the production string depicted in FIG. 1, according to one or more embodiments shown and described in this disclosure.
Figure 4:
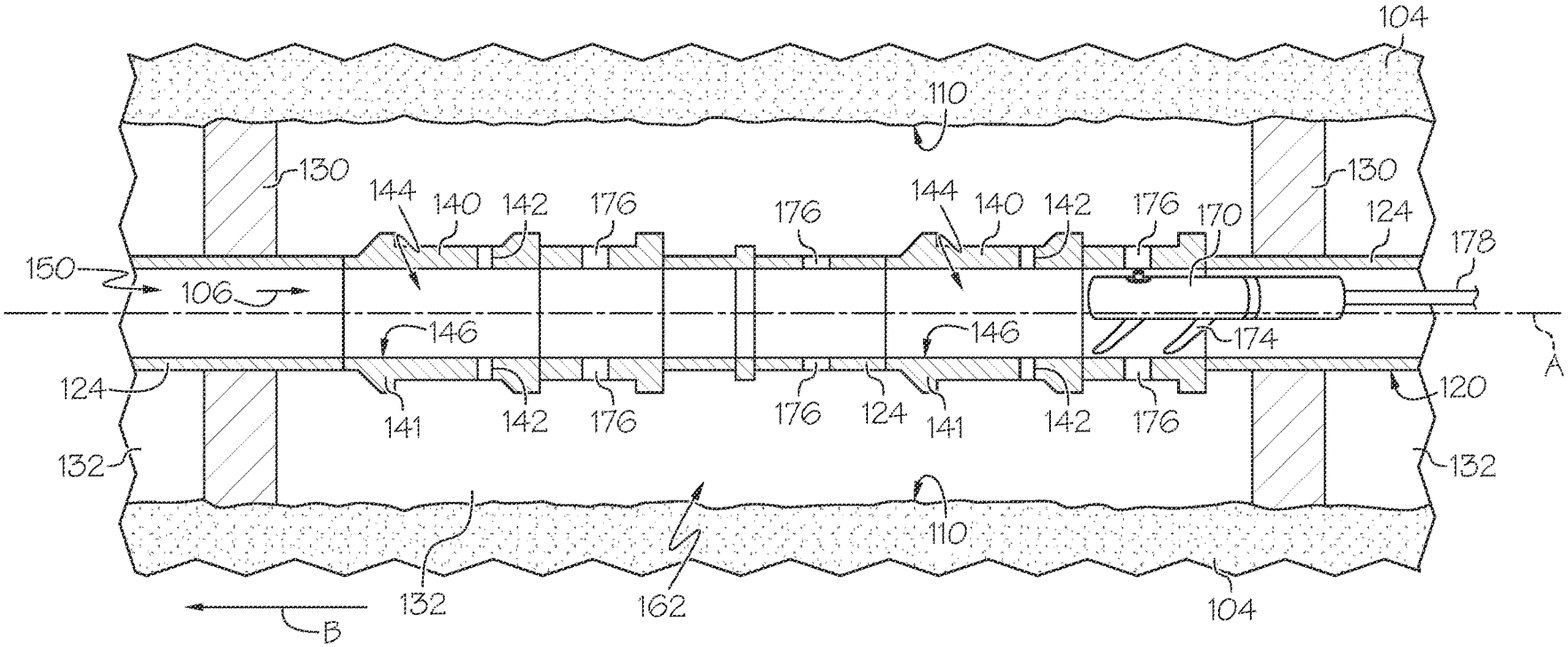
FIG. 4 schematically depicts a side cross-sectional view of the wet interval portion of the production string depicted in FIG. 3 during a perforating step of a method for water shut off of a wet interval, according to one or more embodiments shown and described in this disclosure.
Figure 6:
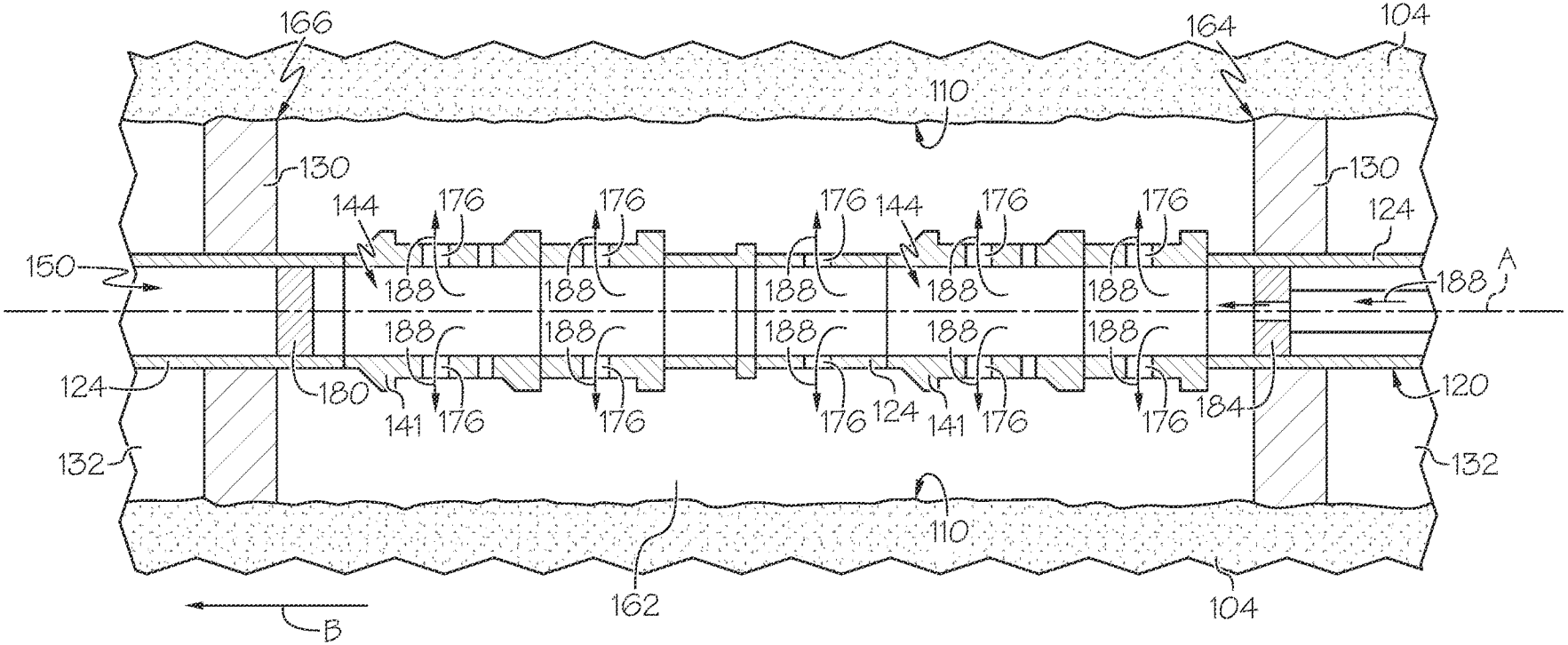
FIG. 6 schematically depicts a side cross-sectional view of the wet interval portion of the production string depicted in FIG. 4 during chemical treatment of the wet interval, according to one or more embodiments shown and described in this disclosure.
Figure 7:
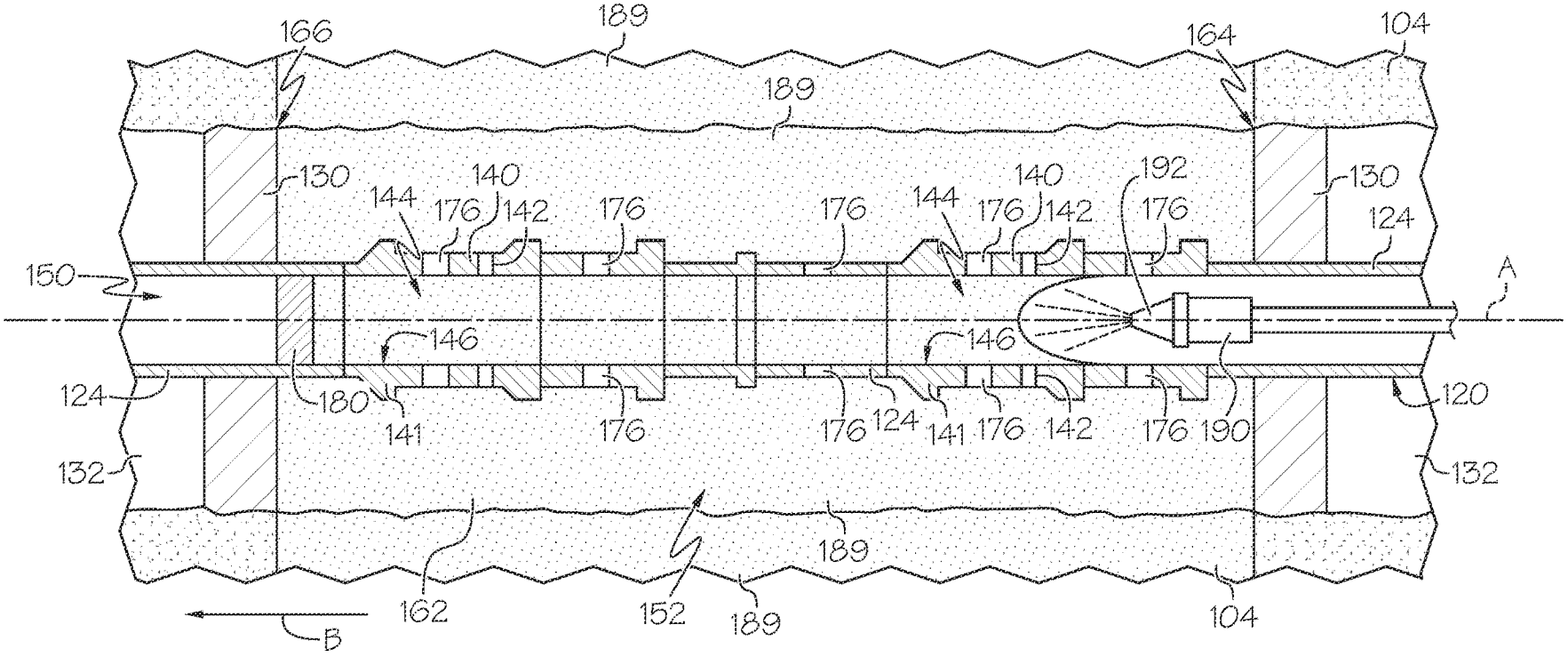
FIG. 7 schematically depicts a side cross-sectional view of the wet interval portion of the production string depicted in FIG. 4 during restoring the fluid flow path through the wet interval, according to one or more embodiments shown and described in this disclosure.
Figure 8:
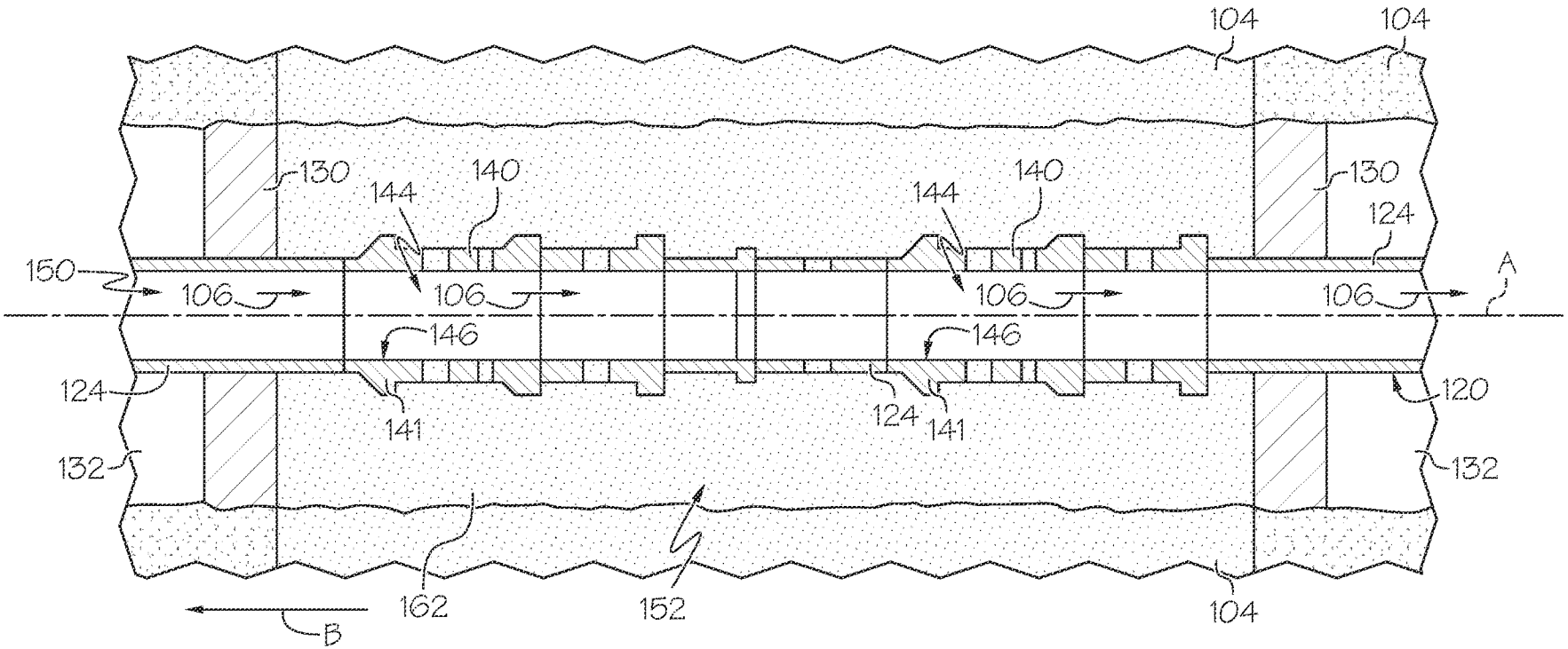
FIG. 8 schematically depicts a side cross-sectional view of the wet interval portion of the production string depicted in FIG. 4 following completion of the water shut-off process and during continued hydrocarbon production from downhole intervals, according to one or more embodiments shown and described in this disclosure.

The present disclosure is directed to methods for selectively shutting off one or more non-productive or wet intervals of a wellbore, which has been completed with a production string comprising a plurality of passive inflow control devices. Referring to FIGS. 2-8, one embodiment of the methods of the present disclosure for selectively shutting off a wet interval 162 of a wellbore 100 is schematically depicted. Referring to FIG. 2, the methods may include producing hydrocarbons 106 from a subterranean hydrocarbon bearing formation 104 through a production string 120 installed in the wellbore 100. The production string 120 may include production tubing 124, a plurality of packers 130 separating the wellbore 100 into a plurality of intervals 132, and a plurality of passive inflow control devices 140 (passive ICDs) positioned across one or more of the plurality of intervals 132. Referring to FIG. 3, the methods may further include identifying the wet interval 162 of the wellbore 100, where the production string 120 in the wet interval 162 may include at least one of the plurality of passive ICDs 140. Referring to FIG. 4, the methods may further include perforating the production string 120 in the wet interval 162 using an explosive-free punch tool 170 to produce a plurality of openings 176 in the production string 120 in the wet interval 162. Referring to FIG. 6, the methods may further include isolating the production string 120 in the wet interval 162 from uphole segments of the production string 120, downhole segments of the production string 120, or both and treating the wet interval 162 with a sealing composition 188 injected through the plurality of openings 176 into an annulus 152 of the wellbore 100 in the wet interval 162. Referring to FIGS. 7 and 8, the methods may further include restoring a fluid flow path through the production string 120 in the wet interval 162. The fluid flowpath through the production string 120 in the wet interval 162 may enable production of hydrocarbons from downhole intervals through the wet interval 162 to a surface 102 of the wellbore 100. The sealing composition cured in the annulus 152 may provide a barrier to prevent fluid flow from the wet interval 162 into the fluid flow path.

As used throughout the present disclosure, the terms "hydrocarbon-bearing formation" and "subterranean hydrocarbon-bearing formation" may each refer to a subterranean geologic region containing hydrocarbons, such as crude oil, hydrocarbon gases, or both, which may be extracted from the subterranean geologic region. The terms "subterranean formation" or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production.

As used throughout the present disclosure, the terms "motherbore" and "central bore" may each refer to the main trunk of a wellbore extending from the surface downward to at least one subterranean formation.

As used throughout the present disclosure, the term "lateral branch" may refer to a secondary bore in fluid communication with the central bore or motherbore and extending from the central bore laterally into a subterranean formation. The central bore may connect each lateral branch to the surface.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component. The downhole direction is indicated in the Figures by arrow B.

As used in the present disclosure, the terms "upstream" and "downstream" may refer to the relative positioning of features of the production string with respect to the direction of flow of the wellbore fluids. A first feature of the production string may be considered "upstream" of a second feature if the wellbore fluid flow encounters the first feature before encountering the second feature. Likewise, the second feature may be considered "downstream" of the first feature if the wellbore fluid flow encounters the first feature before encountering the second feature.

As used throughout the present disclosure, the term "fluid" can include liquids, gases, or both and may include some solids in combination with the liquids, gases, or both, such as but not limited to suspended solids in the wellbore fluids, entrained particles in gas produced from the wellbore, drilling fluids comprising weighting agents, or other mixed phase suspensions, slurries and other fluids.

As used throughout the present disclosure, the term "wet interval" may refer to an interval or compartment of the wellbore that produces an amount of water greater than or equal to 50% by volume of the total fluids produced from that interval. The "wet interval portion" of the production string is used throughout the present disclosure to refer to the portion of the production string that extends through the wet interval of the wellbore.

As used in the present disclosure, a fluid passing from a first feature "directly" to a second feature may refer to the fluid passing from the first feature to the second feature without passing or contacting a third feature intervening between the first and second feature.

As used throughout the present disclosure, unless otherwise stated, the term "annulus" refers to the volume of a wellbore defined between an outer surface of the production string and the inner surface of the wellbore wall or the inner surface of a wellbore casing installed in the wellbore.

As used throughout the present disclosure, the term "curing" may refer to providing time, temperature, and optionally adequate moisture to allow a sealing composition to achieve the desired properties (such as but not limited to hardness or low fluid permeability) for its intended use through one or more reactions between constituents of the sealing composition.

Figure 1:
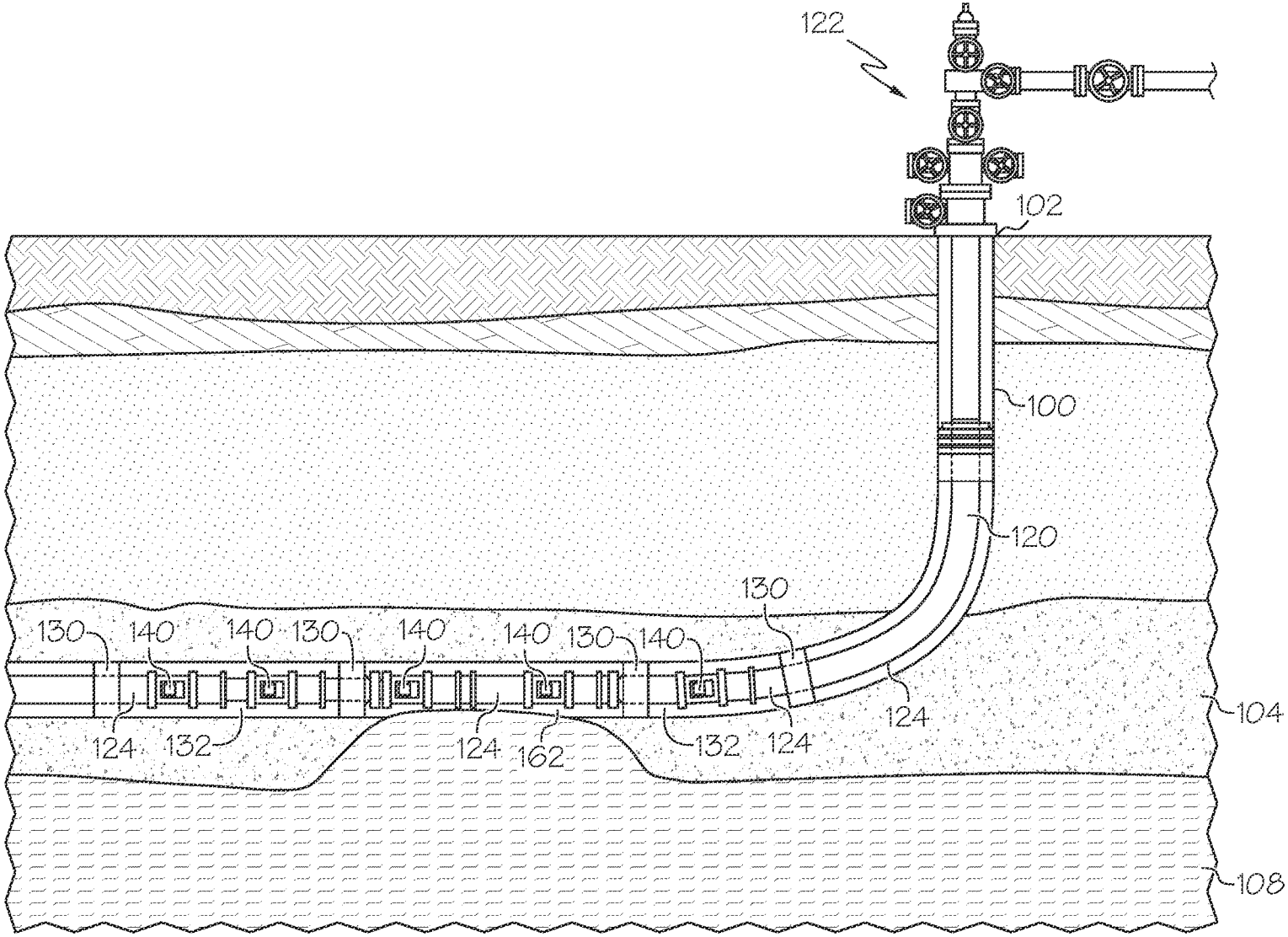
FIG. 1 schematically depicts a wellbore completed with a production string comprising a plurality of passive inflow control devices and a plurality of packers that segment the wellbore into a plurality of intervals, according to one or more embodiments shown and described in this disclosure.

Referring to FIG. 1, a wellbore 100 for producing hydrocarbons from one or more hydrocarbon-bearing subterranean formations 104 is schematically depicted. The wellbore 100 extends from the surface 102 downward to or through one or more hydrocarbon-bearing subterranean formations 104. The wellbore 100 may be a vertical wellbore or a horizontal wellbore, where a horizontal wellbore is characterized as having at least one portion of the wellbore that extends non-vertically through the hydrocarbon-bearing subterranean formation 104. The wellbore 100 may also include a motherbore and a plurality of lateral branches (not shown), which may extend horizontally through different portions of the hydrocarbon-bearing subterranean formation. Throughout the present disclosure, the methods will be described in the context of a horizontal wellbore. However, it is understood that the methods of the present disclosure may also be employed with equal success in vertical production wells and multilateral wells.

The wellbore 100 may be lined or unlined. In embodiments, at least a portion of the wellbore 100 may be lined with one or more casing strings (not shown). When unlined, the annulus 152 of the wellbore 100 may be the annular volume defined between the outer surfaces of the production string 120 and the inner surfaces of the wellbore wall 110. When unlined, fluids can flow directly from the pores of the hydrocarbon bearing subterranean formation 104 into the annulus 152 of the wellbore 100.

Referring again to FIG. 1, the production string 120 is installed in the wellbore 100 to facilitate production of hydrocarbons from the hydrocarbon-bearing subterranean formations 104. The production string 120 may extend from a surface installation 122 disposed at the surface 102 of the wellbore 100 downhole into the wellbore 100 to one or more hydrocarbon-bearing subterranean formations 104. The production string 120 may include production tubing 124, one or a plurality of packers 130, and one or a plurality of passive ICDs 140. The production string 120 may have a center axis A. The production tubing 124 may provide a fluid flow path through the wellbore 100 from the hydrocarbon-bearing subterranean formation 104 to the surface 102 of the wellbore 100. In embodiments, the production string 120 may be disposed in a horizontal portion of the wellbore 100. The production string 120 may further include production logging equipment (not shown), such as one or more sensors and associated electronic equipment, that may be operable to determine fluid flow rates, compositions, formation pressure, formation temperature, or other properties of the wellbore 100.

The plurality of packers 130 may be spaced apart from each other to segment the wellbore 100 into a plurality of intervals 132, where each interval 132 comprises a separate compartment of the wellbore 100. Referring now to FIG. 2, the packers 130 include a central opening coupleable to the production string 120, where the central opening defines at least a portion of the fluid flow path through the production string 120. Each packer 130 comprises an annular sealing portion that extends radially outward from the central opening towards the wellbore wall 110. The annular sealing portion of the packer 130 may be expandable radially outward to engage with the wellbore wall 110 or the interior surface of a casing 112. Engagement of the annular sealing portion of the packer 130 with the wellbore wall 110 or casing 112 may seal the annulus 152 of the wellbore 100 to restrict or prevent fluid flow through the annulus 152 in the uphole or downhole directions. When installed, the packer 130 may allow fluid flow through the wellbore 100 only through the central opening of the packer 130, which may form part of the fluid flow path through the production string 120. The annulus 152 of each interval 132 of the wellbore 100 may be fluidly isolated from the annulus 152 of every other interval 132 by the plurality of packers 130 that block fluid flow uphole and downhole through the annulus 152. The packers 130 may be any commercially available packers suitable for hydrocarbon resource well drilling and production applications.

Referring again to FIG. 1, the production string 120 may further include one or a plurality of passive ICDs 140. The production string 120 may include a plurality of passive ICDs 140, where the passive ICDs 140 are distributed across multiple intervals 132 of the wellbore 100. Each interval 132 may include one or more than one passive ICD 140. The passive ICDs 140 may be used to control the flow rate of fluids from each of the intervals 132 of the wellbore 100 into the fluid conduit 150 (FIG. 2) defined by the production string 120. Referring to FIG. 1, the passive ICDs 140 may be axially distributed along the production string 120 so that each interval 132 of the wellbore 100 may include one or more than one passive ICD 140.

The number and size of each passive ICD 140 installed in the wellbore 100 may be selected at the time of wellbore completion design based on factors such as expected production rate, number of intervals, petrophysical and fluid properties, other factors, or combinations of factors. For instance, the conditions of the hydrocarbon-bearing subterranean formation 104 and the composition and properties of the fluids in the hydrocarbon-bearing subterranean formations 104 may be different between the various intervals 132 of the wellbore 100. The fluids produced in the regions corresponding to the different intervals 132 may have different fluid properties, such as temperature, pressure, viscosity, density, or other properties, depending on the composition of the fluid and formation conditions. Additionally, the permeability or porosity of the hydrocarbon-bearing subterranean formation 104 may vary from interval to interval, resulting in different production flow rates. These differences in the nature of the fluids produced by each interval 132 and the characteristics of the hydrocarbon-bearing subterranean formation 104 at each interval 132 can influence the hydrocarbon production rate from each separate interval 132. The passive ICDs 140 are typically installed in the wellbore 100 at each interval 132 during completion of the wellbore 100 to control the flow of fluids produced from each interval 132 and extend the production life of the wellbore 100.

Referring now to FIG. 2, each passive ICD 140 may comprise a cylindrical wall 141 having one or a plurality of ICD openings 142 radially through the cylindrical wall 141 and a central passage 144 extending axially through the passive ICD 140. The central passage 144 may be defined by an inner surface 146 of the cylindrical wall 141 and may form part of the fluid conduit 150 of the production string 120. The ICD openings 142 in the passive ICD 140 may extend through the cylindrical wall 141 to provide fluid communication between the annulus 152 of the wellbore 100 and the fluid conduit 150 of the production string 120. In embodiments, the passive ICDs 140 may include one or more nozzles defining the ICD openings 142 through the cylindrical wall 141. The inflow areas of the ICD openings 142 in the passive ICDs 140 can be small, such as ICD openings 142 having an inside diameter in the range of from 2 millimeters (mm) to 6 mm ID nozzles, thereby providing flow restriction to reduce and regulate inflow of fluids through each passive ICD 140. The size of the ICD openings 142 of the passive ICDs 140 may be selected to balance inflow from different intervals 132 of the wellbore 100.

Referring now to FIG. 3, as hydrocarbon resource wells mature, water 160 may begin to arrive at one or more of the intervals 132 of the wellbore 100 through high-permeable zones of the hydrocarbon bearing subterranean formation 104. The water 160 can come from water regions naturally occurring in the subterranean formation or from reservoir treatments, such as water flooding treatments or other aqueous chemical treatments, to enhance oil recovery. High-permeability zones of the hydrocarbon bearing subterranean formation 104 may facilitate transport of water from the water zones or chemical treatment zones to the intervals 132 of the wellbore 100. The water flow from the hydrocarbon bearing subterranean formation 104 into the wellbore 100 may increase with time, which can significantly affect the performance of the wellbore 100 for producing hydrocarbons, such as by increasing water production and reducing hydrocarbon production rate from the wellbore 100. Intervals 132 of the wellbore from which an excessive amount of water is produced are referred to throughout the present disclosure as wet intervals 162. The wet interval 162 may produce an amount of water that is greater than or equal to 50% by volume of the total amount of fluids produced from the wet interval 162, as determined through production logging.

Water shut-off techniques applied to one or more wet intervals 162 of the wellbore 100 can reduce or prevent the flow of water from the subterranean formation into the wellbore 100 in the wet interval 162, thereby improving well performance. For passive ICDs 140, mechanical water shut-off techniques are often utilized due to the simple implementation of these techniques, which include but are not limited to ICD patches, straddle packers, and other mechanical isolation devices that can be installed downhole. However, mechanical water shut-off techniques are effective for only a limited amount of time because these mechanical water shut-off devices only isolate the passive ICD 140 and do not extend outward into the hydrocarbon bearing subterranean formation 104. Eventually, the water may find its way through the pores of the subterranean formation 104 around the packers 130 to other intervals 132 of the wellbore 100. Thus, with mechanical isolation techniques, water production from the wellbore 100 can still be a problem and may require mechanical shutoff of multiple intervals 132.

Chemical water shut-off techniques, such as injection of cements or other sealing materials into the wet interval 162, can also be used for water shut-off and can increase the lifespan of the water shut-off installation by expanding the treatment outward into the subterranean formation to damage wet formations deeper into the subterranean formation. Chemical water shut-off can, therefore, be used to block the flow of water into the wet interval 162 at a point farther outward into the hydrocarbon bearing subterranean formation 104. This may delay the water 160 in finding an alternative path to other intervals 132 of the wellbore 100. However, implementation of chemical water shut-offs in passive ICDs 140 is challenging and often impractical due to the small ICD openings 142 in the passive ICDs 140, such as ICD openings 142 or nozzles having an inside diameter of from 2 mm to 6 mm. The small ICD openings 142, which provide flow restriction to regulate fluid flow into the production string 120, can make it difficult to inject the chemical treatment, such as cements or polymeric sealing materials, from the production string 120 out into the annulus 152 or further into the hydrocarbon bearing subterranean formation 104 at the wet interval 162.

As previously discussed, the present disclosure is directed to methods for water shut-off of wet intervals 162 of the wellbore 100, where the methods include perforating the production string 120 in the wet interval 162 with an explosion-free perforation tool, sealing the wet interval 162 with a sealing composition, and reopening the fluid flow path through the wet interval 162 to resume hydrocarbon production from downhole intervals 132 of the wellbore 100. Referring first to FIG. 2, the methods of the present disclosure for water shut off of a wet interval 162 of the wellbore 100 may include producing hydrocarbons 106 from a hydrocarbon bearing subterranean formation 104 through the production string 120 installed in the wellbore 100. As previously discussed, the production string 120 may include production tubing 124, a plurality of packers 130 separating the wellbore 100 into a plurality of intervals 132, and a plurality of passive ICDs 140 positioned across one or more of the plurality of intervals 132. Referring to FIG. 3, the methods may further include identifying the wet interval 162 of the wellbore 100, where the wet interval 162 comprises at least one of the plurality of passive ICDs 140. Referring to FIG. 4, the methods may further include perforating a wet interval portion of the production string 120 using an explosive-free perforation tool 170 to produce a plurality of openings 176 in the wet interval portion of the production string 120. Referring to FIG. 6, the methods may include isolating the wet interval portion of the production string 120 from uphole segments of the production string 120, downhole segments of the production string 120, or both. Referring to FIG. 7, the methods may include dispensing a sealing composition 188 through the wet interval portion of the production string 120, through the plurality of openings 176, and into the annulus 152 of the wellbore 100 in the wet interval 162 and curing the sealing composition 188. Referring to FIG. 8, the methods may include restoring a fluid flow path through the wet interval portion of the production string 120. Referring to FIG. 9, the fluid flow path through the wet interval portion of the production string 120 may enable production of hydrocarbons from downhole intervals 132 through the wet interval 162 to the surface 102. The sealing composition 188 cured in the annulus 152 may provide a barrier to prevent fluid flow from the wet interval 162 into the production string 120.

The methods of the present disclosure may enable chemical water shut off of wet intervals comprising passive ICDs in a very safe and integral manner. The methods of the present disclosure may also provide for perforation of the production string without causing loss of integrity of packers and cross-flow between compartments, particularly when perforating portions of the production tubing in close proximity to the packers. Additionally, the methods of the present disclosure may improve oil production and maximize oil recovery from the wellbore, prolong the lifespan of the wellbore, and extend the high production plateau by shutting off water zones while maintaining hydrocarbon production from downhole intervals of the wellbore. The disclosed methods may further save reservoir energy through reduction of water production. The restored fluid flow path may allow for continued wellbore logging of downhole intervals. The methods of the present disclosure can also be implemented without using a drilling rig, which can reduce the cost of treating the wet interval. The methods of the present disclosure may also allow dead wells to be revived through restoration of production (dead wells reopened and the wet intervals treated according to the methods of the present disclosure so that production can resume from the other intervals of the wellbore). The methods of the present disclosure may also reduce the shut in time and reduce lost time of production compared to other water shut off alternatives, among other features.

Referring again to FIG. 3, the methods of the present disclosure may include identifying the wet interval 162 of the wellbore 100. A wet interval 162 of the wellbore 100 may produce a greater proportion of water relative to hydrocarbons compared to other intervals 132 of the wellbore 100. The wet interval 162 may include one or a plurality of passive ICDs 140. In embodiments, the wellbore 100 may include a plurality of wet intervals 162. When a plurality of wet intervals 162 are present in the wellbore 100, each of the wet intervals 162 may be treated separately according to the methods of the present disclosure. Identifying the wet intervals 162 of the wellbore 100 may include analyzing results from production logging showing hydrocarbon and water production contributions for each of the plurality of intervals 132 of the wellbore 100. Production logging may be accomplished using production logging sensors and equipment known in the art. In embodiments, the production logging may comprise running multi-phase horizontal production logging (PLT) to identify locations of water and oil entries into the wellbore 100. As previously discussed, the wet intervals 162 of the wellbore 100 are the intervals for which the production of water is at least 50% by volume of the total fluid production from the interval. In embodiments, the production logging equipment may be removed from the wet interval 162 prior to perforating the production string 120 in the wet interval 162.

Referring now to FIG. 4, after identifying the wet intervals 162 of the wellbore 100, the methods of the present disclosure include perforating the wet interval portion of the production string 120 using an explosive-free perforation tool 170 to produce a plurality of openings 176 in the production string 120 throughout the wet interval 162. The wet interval portion of the production string 120 refers to the portion of the production string 120 extending between the packers 130 at each end of the wet interval 162 of the wellbore 100. The plurality of openings 176 may be made in the production tubing 124, the one or more passive ICDs 140, other equipment, or combinations of these making up the wet interval portion of the production string 120. Perforating the wet interval portion of the production string 120 may include positioning the explosion-free perforation tool 170 within the wet interval portion of the production string 120 and operating the explosion-free perforation tool 170 to produce the plurality of openings 176 in the wet interval portion of the production string 120. The openings 176 or perforations in the wet interval portion of the production string 120 may be produced at multiple axial positions throughout the wet interval 162. Additionally, the openings 176 or perforations may be formed in the wet interval portion of the production string 120 at multiple angular positions through 360 degrees to ensure complete filling of the annulus with the sealing composition 188 during injection.

Figure 5:
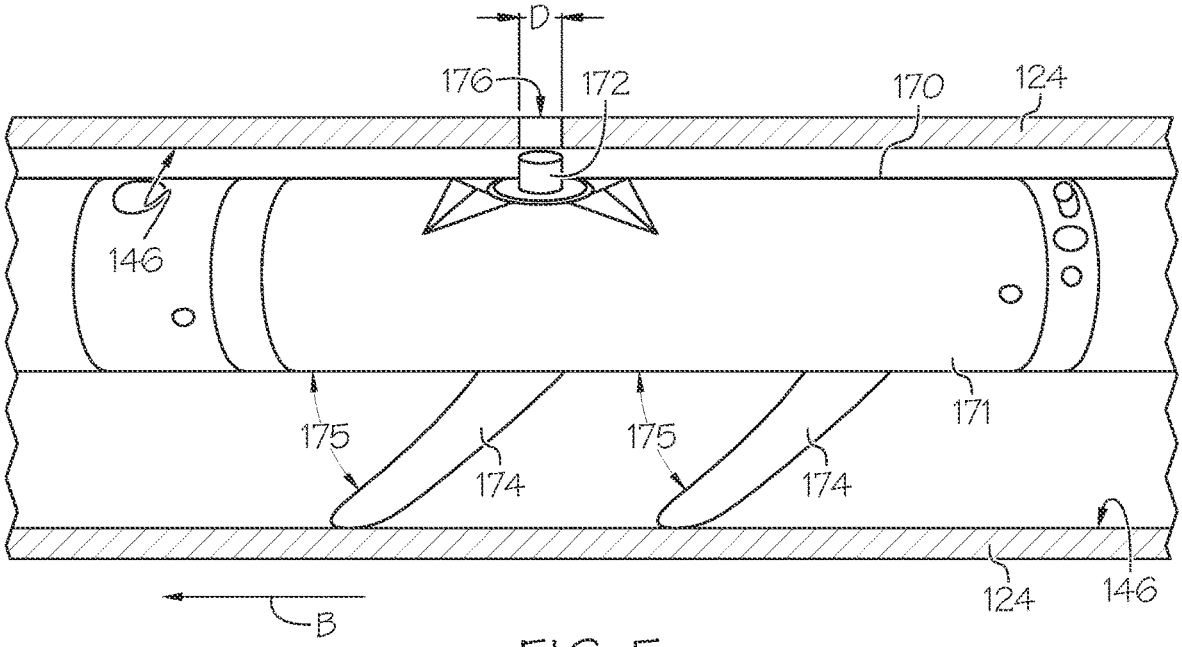
FIG. 5 schematically depicts a side view of a perforation tool, according to one or more embodiments shown and described in this disclosure.

Referring now to FIG. 5, an embodiment of the explosion-free perforation tool 170 according to the present disclosure is schematically depicted. In FIG. 5, the downhole direction is indicated by arrow B. The explosion-free perforation tool 170 may include a body 171 and a tool 172 that may be extendable in a radial direction from the body 171 to engage with the inner surface 146 of the passive ICDs 140, production tubing 124, or other component of the wet interval portion of the production string 120. The tool 172 may be a punching tool, a drilling/milling tool, or other type of tool capable of forming a perforation in the metal of the passive ICD 140, production tubing 124, or other equipment. In embodiments, the tool 172 may be a punching tool coupled to an actuator that is operable to translate the punching tool radially outward from the body 171 to punch a hole through the passive ICD 140, production tubing 124, or both. The actuator may be electrical or hydraulic. In embodiments, the tool 172 may be a drilling tool or a milling tool operable to drill or mill through the metal of the passive ICD 140, production tubing 124, or both to produce the openings 176 in the wet interval portion of the production string 120. The drilling tool or milling tool may be operated by an electric or hydraulic drive. The tool 172 may be operatively coupled to a power source (not shown) at the surface 102. In embodiments, the power source may be an electrical power source, and the tool 172 may be electrically coupled to the electrical power source through an electrical line extending downhole. In embodiments, the power source may be a hydraulic power source, and the tool 172 may be hydraulically coupled to the hydraulic power source through a hydraulic line extending downhole.

The explosion-free perforation tool 170 may further include one or more arms 174, which may be operable to position the explosion-free perforation tool 170 within the production string 120 and anchor the explosion-free perforation tool 170 during operation. The arms 174 may pivot radially outward from the body 171 as shown by the arrows 175 in FIG. 5. The arms 174 may be operatively coupled to arm actuators (not shown) operable to pivot the arms 174 between an engaged position and a disengaged position. In the engaged position, the arms 174 may contact the inner surface 146 of the production string 120 to position and anchor the explosion-free punch tool 170. In the disengaged position, the arms 174 may pivot back into a recessed position within the explosion-free punch tool 170 so that the explosion-free punch tool 170 can be repositioned within the production string 120. The arm actuators may be electric actuators or hydraulic actuators and may be operatively coupled to a power source at the surface 102 through one or more electrical lines or hydraulic lines, respectively.

Operation of conventional explosion based perforation tools, such as perforation guns and the like, too close to the packers 130 can result in loss of integrity of the packers 130 and cross-flow between intervals 132 due to the inability to adequately control the forces of the explosions. The unpredictability of the explosions used in conventional explosion based perforation guns can also make it difficult to control the size and shape of the openings created in the production string 120.

The methods of the present disclosure utilize the explosion-free perforation tool 170, which is a purely mechanical device and does not rely on explosions or use of explosives to create the openings 176 in the wet interval portion of the production string 120. Therefore, the explosion-free perforation tool 170 may be operated to produce openings 176 in the production string 120 close to the packers 130 without resulting in loss of integrity of the packers 130, which can lead to loss of interval isolation and cross-flow between intervals 132. In embodiments, perforating the wet interval portion of the production string 120 does not result in loss of integrity of any one of the plurality of packers 130 disposed between intervals 132 or cross-flow of fluids through the annulus 152 between intervals 132, such as between the wet interval 162 and either of the adjacent intervals 132 of the wellbore 100.

The explosion-free perforation tool 170 may further enable control of the size and shape of the openings 176 made in the wet interval portion of the production string 120. Thus, operation of the explosion-free perforation tool 170 may produce a plurality of openings 176 with consistent size and shape, which may allow for more even distribution of the sealing composition 188 throughout the annulus 152 of the wet interval 162 during the injecting step. The number and size of the openings 176 may be determined based on the injection volume and injection rate of the sealing compositions 188 for sealing the particular wet interval 162. The injection volume and injection rate of the sealing compositions 188 may be determined from the wellbore and completion modeling using wellbore logging data.

Referring again to FIG. 5, the openings 176 may be of sufficient size to enable the sealing compositions 188 to be injected into the annulus 152 of the wet interval 162 at the injection rate of the sealing composition 188 determined from the wellbore and completion modeling. The openings 176 may have a largest cross-sectional dimension D of greater than 6 mm, greater than or equal to 8 mm, greater than or equal to 10 mm, or even greater than or equal to 15 mm. The openings 176 have a largest cross-sectional dimension D of less than or equal to 50 mm, less than or equal to 25 mm, less than or equal to 20 mm, or less than or equal to 15 mm. The openings 176 may have a largest cross-sectional dimension D of from greater than 6 mm to 25 mm, from greater than 6 mm to 20 mm, from greater than 6 mm to 15 mm, from greater than 6 mm to 10 mm, from 8 mm to 25 mm, from 8 mm to 20 mm, from 8 mm to 15 mm, from 10 mm to 25 mm, from 10 mm to 20 mm, from 10 mm to 15 mm, from 15 mm to 25 mm, or from 15 mm to 20 mm. In embodiments, the openings 176 have a largest cross-sectional dimension D of 15 mm. In embodiments, all of the openings 176 may be the same size, such as having the same largest cross-sectional dimension D.

The total number of openings 176 created in the wet interval 162 may be sufficient to enable the sealing compositions 188 to be injected into the annulus 152 of the wet interval 162 at the injection rate of the sealing composition 188 determined from the wellbore and completion modeling. The total number of openings 176 created in the wet interval 162 may be sufficient to evenly distribute the sealing compositions 188 throughout the annulus 152. The number of openings 176 created in the wet interval 162 may depend on the length of the wet interval 162, the total volume of the annulus 152, the permeability of the surrounding hydrocarbon bearing subterranean formation 104, formation pressure and temperature, other factors, or combinations of these. The number of openings 176 created in the wet interval 162 may be greater than or equal to 1, greater than or equal to 2, or greater than or equal to 4. The number of openings 176 created in the wet interval 162 may be from 1 to 50, from 1 to 40, from 1 to 20, from 1 to 10, from 1 to 4, from 2 to 50, from 2 to 40, from 2 to 20, from 2 to 10, from 1 to 4, from 4 to 50, from 4 to 40, from 4 to 20, from 4 to 10, or from 10 to 50. In embodiments, a single opening 176 may be sufficient to inject the sealing compositions 188, provided the wet interval 162 is from 100 feet (30 meters) to 600 feet (183 meters) in length and the subterranean formation is not a high permeability zone that would require a greater injection rate and volume.

Because the explosion-free perforation tool 170 does not rely on explosives to create the openings 176, perforating the wet interval portion of the production string 170 may not result in loss of integrity of any one of the plurality of packers 130 disposed between intervals 132. Maintaining the integrity of the packers 130 at either end of the wet interval 162 may reduce or prevent cross-flow of fluids, such as water or the sealing compositions 188, through the annulus 152 between intervals, such as from the wet interval 162 to either one of the adjacent intervals 132.

Referring again to FIG. 4, the explosion-free perforation tool 170 may be lowered downhole and positioned in the wet interval 162 using a slickline 178. The explosion-free perforation tool 170 may also be coupled to a wireline or coiled tubing for lowering and positioning the explosion-free perforation tool 170 in the wet interval 162. Positioning the explosion-free perforation tool 170 within the wet interval portion of the production string 120 may be conducted using a slickline 178, wireline, or coiled tubing. In embodiments, positioning the explosion-free perforation tool 170 within the wet interval portion of production string 120 is rigless, meaning that positioning the perforation tool 170 in the production string 120 does not require a drilling rig.

Referring again to FIG. 4, the explosion-free perforation tool 170 may be used to produce a plurality of openings 176 distributed angularly and axially throughout the wet interval 162. In embodiments, perforating the wet interval portion of the production string 120 may include producing the plurality of openings 176 distributed angularly through 360 degrees relative to the center axis A of the production string 120. Producing the plurality of openings 176 distributed angularly through 360 degrees may include rotating the explosion-free perforation tool 170 within the wet interval portion of the production string 120 by an angle less than or equal to 180 degrees between each operation of the explosion-free perforation tool 170. In embodiments, perforating the wet interval portion of the production string 120 may include producing the plurality of openings 176 at multiple axial locations of the wet interval portion of the production string 120 relative to a center axis A of the production string 120.

In embodiments, a single explosion-free perforation tool 170 may be used to produce the plurality of openings 176. In these embodiments, the single explosion-free perforation tool 170 may be lowered downhole to a first axial position in the wet interval 162. At the first axial, the single explosion-free perforation tool 170 may be operated to form one opening 176 at the first axial position and then rotated and operated again to form a second opening 176 at the same axial position but at a different angular position relative to the one opening 176. Other openings 176 distributed around 360 degrees about the center axis A of the production string 120 at the first axial position may be formed by alternatingly rotating and operating the single explosion-free perforation tool 170, while maintaining the axial position of the explosion-free perforation tool 170. Once all the opening 176 distributed through 360 degrees are formed at the first axial position, the single explosion-free perforating tool 170 may be repositioned at a second axial position. In embodiments, producing the plurality of openings 176 at multiple axial locations in the wet interval 162 may include operating the single explosion-free perforation tool 170 at a plurality of different depths or downhole positons throughout the wet interval portion of the production string 120. Axial repositioning of the single explosion-free perforation tool 170 may be combined with rotation of the explosion-free perforation tool 170 to form the openings 176 that are axially and angularly distributed through the wet interval portion of the production string 120. In embodiments, the explosion-free perforation tool 170 may be translated in a spiral path through the wet interval portion of the production string 120 so that each of the plurality of openings 176 has a different axial and angular position relative to each of the other openings 176. In embodiments, positioning of the openings 176 can be non-evenly spaced angularly and/or axially or even randomly positioned.

In embodiments, the openings 176 may also be formed using a plurality of explosion-free perforation tools 170 arranged in series within the production string 120. In embodiments, producing the plurality of openings 176 at multiple axial locations may include coupling a plurality of explosion-free perforation tools 170 in series and positioning the plurality of explosion-free perforation tools 170 within the wet interval portion of the production string 120 so that the plurality of explosion-free perforation tools 170 are distributed axially throughout the wet interval portion of the production string 120. Once positioned, the plurality of explosion-free perforation tools 170 may be operated in sequence or simultaneously to form the openings 176 distributed axially across the wet interval portion of the production string 120. The entire assembly of the plurality of explosion-free perforation tools 170 may then be rotated and operated one or more times to produce additional openings 176 distributed angularly through 360 degrees about the center axis A of the production string. In some cases, the assembly of the plurality of explosion-free perforation tools 170 may have a length less than 75% of the total length of the wet interval 162. In these instances, the assembly of the plurality of explosion-free perforation tools 170 may be operated in a first region of the wet interval portion of the production string 120 and then axially repositioned in a second region of the wet interval portion of the production string 120 and operated to form additional openings 176 in the second portion of the wet interval portion of the production string 120.

Referring now to FIG. 6, following perforation of the wet interval portion of the production string 120, the methods of the present disclosure may include isolating the wet interval portion of the production string 120 from uphole segments of the production string 120, downhole segments of the production string 120, or both. Isolating the wet interval portion of the production string 120 may include installing an inflatable packer 180 within the production string 120 at a downhole end 166 of the wet interval 162. The inflatable packer 180 may be any commercially available inflatable packer capable of being inserted into the production string 120, positioned at the downhole end 166 of the wet interval 162, and inflated or expanded to block the fluid flow path through the fluid conduit 150 of the production string 120 to prevent fluids from flowing through the production string 120 from the wet interval 162 to downhole segments of the production string 120. Isolating the wet interval portion of the production string 120 may further include installing a cement retainer 184 in the production string 120 at an uphole end 164 of the wet interval 162. In embodiments, the cement retainer 184 may be an inflatable cement retainer.

Each of the inflatable packer 180 and cement retainer 184 can be inflated or expanded with wellbore fluids using separate electric pumps (not shown), each of which is operatively coupled to the inflatable packer 180 and the cement retainer 184, respectively. The inflatable section of each of the inflatable packer 180, the cement retainer 184, or both may be constructed of a reinforced rubber composition for durability during repeated usage of the assembly. The separate electrical pumps for the inflatable packer 180, the cement retainer 184, or both may each be electrically coupled to controls disposed at the surface 102 of the wellbore 100. Electrical wiring may extend from the controls at the surface 102 downhole to the separate pumps. Although isolation is shown in FIG. 6 as including an inflatable packer 180 at the downhole end 166 of the wet interval 162 and a cement retainer 184 at the uphole end 164 of the wet interval 162, other methods and devices may be employed to fluidly isolate the wet interval portion of the production string 120.

Referring again to FIG. 6, once the wet interval portion of the production string 120 has been isolated, the methods may include dispensing the sealing composition 188 through the wet interval portion of the production string 120, through the plurality of openings 176, and into the annulus 152 of the wellbore 100 in the wet interval 162. As previously discussed, the annulus 152 is the annular volume defined between the production string 120 and the wellbore wall 110 of the wellbore 100. Dispensing the sealing composition 188 may include injecting or squeezing the sealing composition 188 into the wet interval portion of the production string 120 through the cement retainer 184. When dispensed (injected or squeezed), the sealing composition 188 may flow through the wet interval portion of the production string 120 and out through the plurality of openings 176 into the annulus 152. The sealing composition 188 may be injected until the entire annulus 152 is filled with the sealing composition 188. In embodiments, the sealing composition 188 may be injected until the sealing composition 188 penetrates into the hydrocarbon bearing subterranean formation 104 by a prescribed distance. The injection pressure, injection volume, or both of the sealing composition 188 may be sufficient to cause the sealing composition 188 to penetrate radially outward into the hydrocarbon-bearing subterranean formation 104 to create a barrier farther out into the hydrocarbon-bearing subterranean formation 104. Extending the barrier to water flow farther out into the hydrocarbon-bearing subterranean formation 104 may further prolong the life-span of the water-shut off by reducing or eliminating the paths of least resistance for water reaching the wellbore 100 and may cause the water to reroute through other less permeable regions of the hydrocarbon bearing subterranean formation 104. The injection pressure, volume, or both of the sealing composition 188 may depend on the size of the wet interval 162, volume of the annulus 152, and the characteristics of the hydrocarbon-bearing subterranean formation 104, such as but not limited to permeability, fluid production rate, formation pressure, the temperature, or other characteristics of the hydrocarbon-bearing subterranean formation 104.

The sealing composition 188 may be any composition that can be dispensed into the annulus 152 as a liquid or slurry and then cured to form a solid or semi-solid that provides a barrier to fluid flow from the hydrocarbon-bearing subterranean formation 104 in the wet interval 162 to the production string 120. The sealing compositions 188 can be a cement composition, a curable polymer composition, or combinations of these. Any known cement composition, curable polymer composition, or combinations thereof suitable for use in subterranean resource well drilling may be used. Cement compositions may include Portland cement. Suitable cement compositions may include cement compositions conforming to any of American Petroleum Institute's (API) class A through class H cement standards. In embodiments, the sealing composition 188 may be an API class G or class H Portland cement. Curable polymer compositions may include epoxy resin systems comprising an epoxy resin and a cross-linker. The curable polymer compositions may be used as the sealing compositions 188 or may be combined with a cement composition to form the sealing compositions 188. The presence of a curable polymer may improve the fluid barrier properties of the sealing composition 188 once cured and may reduce or prevent cracking of the cured sealing composition 188.

Referring now to FIG. 7, after injecting the sealing composition into the annulus 152 in the wet interval 162, the methods of the present disclosure may include curing the sealing composition in the annulus 152 to form a cured sealing composition 189. Curing may include allowing the sealing composition, such as the wellbore cement, curable polymer, or both, to harden into a cured sealing composition 189. The sealing composition may be cured in the annulus 152 by shutting in the sealing composition for a shut-in time sufficient to allow the sealing composition to harden into the cured sealing composition 189 that is a solid or semi-solid capable of providing a fluid barrier. The shut-in time may be greater than or equal to 1 hour, greater than or equal to 2 hours, greater than or equal to 4 hours, or greater than or equal to 8 hours. The shut-in time may be less than or equal to 96 hours, less than or equal to 48 hours, less than or equal to 24 hours, or even less than or equal to 12 hours. The cured sealing composition 189 may form a barrier in the annulus 152 of the wet interval 162 that may reduce or prevent the flow of fluids from the hydrocarbon bearing subterranean formation 104 in the wet interval 162 to the production string 120. In embodiments, the fluid barrier formed by the cured sealing composition 189 may extend outward into the hydrocarbon bearing subterranean formation 104 as shown in FIG. 7.

The methods of the present disclosure may include, after curing the sealing composition to form the cured sealing composition 189 in the annulus 152, confirming isolation of the wet interval 162 from the production string 120. Confirming isolation of the wet interval 162 from the production string 120 may include conducting a negative pressure test. The negative pressure test may be conducted at a test pressure that is 500 pounds per square inch (3447 kilopascals) less than the reservoir pressure of the hydrocarbon bearing subterranean formation 104. The negative pressure test may be conducted using known equipment and methods.

Referring again to FIG. 7, after curing and negative pressure testing, the methods of the present disclosure may include restoring the fluid flow path through the production string 120 in the wet interval 162. Restoring the fluid flow path through the production string 120 in the wet interval 162 may enable production of hydrocarbons from downhole intervals 132 through the wet interval 162 to the surface 102. Restoring the fluid flow path through the production string 120 in the wet interval 162 may include removing the inflatable cement retainer 184 disposed within the production string 120 at the uphole end 164 of the wet interval 162. The inflatable cement retainer 184 may be retrieved and retained for reuse. Restoring the fluid flow path may further include cleaning out the cured sealing composition 189 from the fluid conduit 150 defined by the production string 120 in the wet interval 162 and removing the inflatable packer 180 disposed at the downhole end 166 of the wet interval 162. The cement retainer 184 may be removed using a wireline tool or other device capable of retrieving the cement retainer 184.

Cleaning out the cured sealing composition 189 from the central passage 144 of the production string 120 in the wet interval 162 may include conducting coil tubing clean out. Coil tubing clean out may include jetting and drifting, mechanical clean out, or other removal technique. Jetting and drifting refers to a process of alternating application of a fluid jet to remove material from the central passage 144 of the production string 120 with measurement of the inside diameter of the production string 120 to verify that tools and equipment are able to fit through the cleaned out production string 120. As shown in FIG. 7, jetting may be accomplished by deploying and operating a jetting tool 190 downhole in the wet interval portion of the production string 120. The jetting tool 190 may comprise at least one high pressure fluid nozzle 192 operable to produce a high pressure fluid jet. The high pressure fluid jet may be operable to break up the cured sealing composition 189 within the production string 120. The jetting tool 190 may be deployed downhole using a slickline, wireline, or coiled tubing. The jetting tool 190 may be fluidly coupled to the surface 102 for delivery of the fluid to the jetting tool 190. One or more measuring tools may be coupled to the jetting tool 190 or may be independently deployed downhole to measure the inside diameter of the production string 120 in the wet interval 162 following jetting. Additionally or alternatively, in embodiments, one or mechanical devices, such as drilling bits or other mechanical devices for material removal, may be deployed downhole for removal of the cured sealing composition 189 from the central passage 144 of the production string 120 in the wet interval 162. Following removal of the cured sealing composition 189, the inflatable packer 180 disposed within the production string 120 at the downhole end 166 of the wet interval 162 may be removed and retrieved. The inflatable packer 180 may be removed using a wireline tool or other device capable of retrieving the inflatable packer 180.

Referring now to FIG. 8, the equipment disposed downhole in the wet interval portion of the production string 120 for treating the wet interval 162 may be pulled out of the production string 120 to leave the fluid flow path through the production string 120 from the downhole end 166 of the wet interval 162 to the uphole end 164 of the wet interval 162. The fluid flow path through the production string 120 in the wet interval 162 may enable continued use of the production string 120 to produce hydrocarbons from the hydrocarbon bearing subterranean formations 104 downhole of the wet interval 162. The fluid flow path through the wet interval 162 may allow fluids to flow from downhole intervals 132, through the wet interval 162, to the surface 102. The cured sealing composition 189 in the wet interval 162 may provide a fluid barrier to reduce or prevent water and other fluids from the formation from flowing to the production string 120 through the wet interval 162. In other words, the cured sealing composition 189 in the wet interval 162 shuts-off fluid flow from the wet interval 162 to the production string 120. The methods of the present disclosure may further include resuming hydrocarbon production from intervals 132 downhole of the wet interval 162.

Referring again to FIG. 1, in embodiments, the methods of the present disclosure for shutting off a wet interval 162 of the wellbore 100 may be conducted with coiled tubing and without installation of a drilling or production rig at the surface 102. In embodiments, the methods may be conducted using a drilling rig or production rig, such as when the drilling rig or production rig is already in place at the surface.

The methods of the present disclosure have been shown and described in conjunction with production strings 120 disposed in horizontal sections or branches of the wellbore 100. However, it is understood that the methods of the present disclosure for water shut-off of wet intervals 162 of the wellbore 100 may be conducted in vertical or angled intervals 132 of the wellbore 100 with equal success.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A method for shutting off a wet interval of a wellbore, the method comprising:

producing hydrocarbons from a hydrocarbon bearing subterranean formation through a production string installed in the wellbore, where the production string comprises:

production tubing;

a plurality of packers separating the wellbore into a plurality of intervals; and a plurality of passive inflow control devices positioned across one or more of the plurality of intervals;

identifying the wet interval of the wellbore, where the production string in the wet interval comprises at least one of the plurality of passive inflow control devices;

perforating the production string in the wet interval using an explosive-free punch tool to produce a plurality of openings in the production string in the wet interval;

isolating the production string in the wet interval from uphole segments of the production string, downhole segments of the production string, or both, where isolating the production string comprises:

installing an inflatable packer within the production string at a downhole end of the wet interval; and installing a cement retainer within the production string at an uphole end of the wet interval;

treating the wet interval with a sealing composition injected through the plurality of openings into an annulus of the wellbore in the wet interval;

restoring a fluid flow path through the production string in the wet interval, where:

the fluid flow path through the production string in the wet interval enables production of hydrocarbons from downhole intervals through the wet interval to a surface of the wellbore; and the sealing composition cured in the annulus provides a barrier to prevent fluid flow from the wet interval into the fluid flow path.

2. The method of claim 1, where the plurality of openings produced in the production string are formed in the production tubing, the at least one of the plurality of passive inflow control devices, or both.

3. The method of claim 1, where perforating the production string in the wet interval comprises:

positioning the explosion-free punch tool within the production string in the wet interval; and operating the explosion-free punch tool to produce the plurality of openings in the production string.

4. The method of claim 3, where positioning the explosion-free punch tool within the production string is conducted using a slickline, wireline, or coiled tubing.

5. The method of claim 1, where perforating the production string in the wet interval comprises producing the plurality of openings at multiple axial locations of the production string in the wet interval relative to a center axis of the production string.

6. The method of claim 5, where producing the plurality of openings at multiple axial locations comprises operating the explosion-free punch tool at a plurality of different depths throughout the wet interval.

7. The method of claim 5, where producing the plurality of openings at multiple axial locations comprises coupling a plurality of explosion-free punch tools in series and positioning the plurality of explosion-free punch tools within the production string in the wet interval so that the plurality of explosion-free punch tools are distributed axially throughout the wet interval.

8. The method of claim 1, where perforating the production string in the wet interval comprises producing the plurality of openings distributed angularly through 360 degrees relative to a center axis of the production string.

9. The method of claim 8, where producing the plurality of openings distributed angularly through 360 degrees comprises rotating the explosion-free punch tool within the production string by an angle less than 180 degrees between each operation of the explosion-free punch tool.

10. The method of claim 8, where perforating the production string in the wet interval comprises producing the plurality of openings at a plurality of axial locations of the production string in the wet interval relative to the center axis of the production string.

11. The method of claim 1, where perforating the production string in the wet interval does not result in loss of integrity of any of the plurality of packers disposed between intervals and does not result in cross-flow of fluids through the annulus between intervals.

12. The method of claim 1, where each of the plurality of openings has a diameter of from 6 millimeters to 20 millimeters.

13. The method of claim 1, where treating the wet interval with the sealing composition comprises:

dispensing the sealing composition through the production string, through the plurality of openings in the production string in the wet interval, and into an annulus of the wellbore in the wet interval, where the annulus is the annular volume defined between the production string and a wellbore wall of the wellbore; and curing the sealing composition in the annulus of the wellbore in the wet interval.

14. The method of claim 13, comprising dispensing the sealing composition into the annulus of the wellbore until the sealing composition penetrates into the subterranean formation in the wet interval.

15. The method of claim 1, further comprising, after treating the wet interval with a sealing composition, confirming isolation of the wet interval from the production string.

16. The method of claim 1, where restoring a fluid flow path through the production string in the wet interval comprises:

removing an inflatable cement retainer disposed within the production string at an uphole end of the wet interval;

cleaning out the sealing composition from a central cavity of the production string in the wet interval; and removing an inflatable packer disposed within the production string at a downhole end of the wet interval.

17. The method of claim 1, where identifying the wet interval of the wellbore comprises analyzing results from production logging showing hydrocarbon and water production contributions for each of the plurality of intervals of the wellbore.

18. The method of claim 1, where the method is conducted without the installation of a production rig.

19. The method of claim 1, where the plurality of intervals of the wellbore are in a horizontal portion of the wellbore.

20. A method for shutting off a wet interval of a wellbore, the method comprising:

producing hydrocarbons from a hydrocarbon bearing subterranean formation through a production string installed in the wellbore, where the production string comprises:

production tubing;

a plurality of packers separating the wellbore into a plurality of intervals; and a plurality of passive inflow control devices positioned across one or more of the plurality of intervals;

identifying the wet interval of the wellbore, where the production string in the wet interval comprises at least one of the plurality of passive inflow control devices;

perforating the production string in the wet interval using an explosive-free punch tool to produce a plurality of openings in the production string in the wet interval;

isolating the production string in the wet interval from uphole segments of the production string, downhole segments of the production string, or both;

treating the wet interval with a sealing composition injected through the plurality of openings into an annulus of the wellbore in the wet interval;

restoring a fluid flow path through the production string in the wet interval, where:

restoring a fluid flow path through the production string in the wet interval comprises:

removing an inflatable cement retainer disposed within the production string at an uphole end of the wet interval;

cleaning out the sealing composition from a central cavity of the production string in the wet interval; and removing an inflatable packer disposed within the production string at a downhole end of the wet interval;

the fluid flow path through the production string in the wet interval enables production of hydrocarbons from downhole intervals through the wet interval to a surface of the wellbore; and the sealing composition cured in the annulus provides a barrier to prevent fluid flow from the wet interval into the fluid flow path.

* * * * *